US006873254B2

(12) United States Patent
Andres et al.

(10) Patent No.: US 6,873,254 B2
(45) Date of Patent: Mar. 29, 2005

(54) MULTICONDITION DETECTION APPARATUS AND METHOD PROVIDING INTERLEAVED TONE AND VERBAL WARNINGS

(75) Inventors: John J. Andres, Colorado Springs, CO (US); Micahel W. Apperson, Chapel Hill, NC (US); Stephen M. Ernst, Colorado Springs, CO (US); Chris R. Gilbert, Colorado Springs, CO (US); Richard Kwor, Colorado Springs, CO (US); Joseph G. DeLuca, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

(21) Appl. No.: 10/339,845

(22) Filed: Jan. 10, 2003

(65) Prior Publication Data

US 2003/0098790 A1 May 29, 2003

Related U.S. Application Data

(63) Continuation of application No. 09/271,574, filed on Mar. 18, 1999, now Pat. No. 6,522,248.

(51) Int. Cl.[7] ..... G08B 19/00

(52) U.S. Cl. ..... 340/521; 340/511; 704/273; 704/274

(58) Field of Search ..... 340/521, 506, 340/511, 517, 531, 532, 522, 577, 533, 286.11; 704/273, 274

(56) References Cited

U.S. PATENT DOCUMENTS 3,922,656 A 11/1975 Horvath et al.
4,088,986 A 5/1978 Boucher
4,453,222 A 6/1984 Goszyk
4,688,021 A 8/1987 Buck et al.
4,816,809 A 3/1989 Kim
4,821,027 A 4/1989 Mallory et al.
5,086,385 A 2/1992 Launey et al.
5,146,209 A 9/1992 Beghelli
5,291,183 A 3/1994 Chiang
5,307,051 A 4/1994 Sedlmayr
5,331,310 A 7/1994 Stetter et al.
5,568,130 A 10/1996 Dahl (Continued)

*Primary Examiner*—Daryl C. Pope
(74) *Attorney, Agent, or Firm*—Merchant & Gould P.C.

(57) ABSTRACT

An apparatus for the detection and enunciation of hazardous conditions within an environment comprises at least two detection circuits positioned to sense ambient conditions within a home or business environment. One of the detection circuits senses the presence of smoke, and the other detection circuit senses the presence of carbon monoxide. The apparatus also comprises an alarm circuit which is responsive to each of the detection circuits for generating at least one alarm pattern, and preferably a separate alarm pattern for each different sensed condition. A voice synthesizer circuit is also included, and is responsive to each of the detection circuits for generating at least one voice message. As with the alarm patterns, the voice synthesizer preferably generates separate voice messages for each separate detected condition. The apparatus advantageously also contains an interleaving control circuit. This interleaving control circuit interleaves the alarm patterns and voice messages in a predetermined sequence to reduce confusion in an emergency situation. A method for the detection and enunciation of multiple hazardous condition within an environment is also presented, and comprises the steps of: (a) sensing ambient conditions within the environment to detect at least two hazardous condition; (b) generating an alarm pattern and a voice message in response to sensing the hazardous conditions; (c) interleaving the alarm pattern and the voice message; and (e) enunciating these interleaved alarm patterns and voice.

35 Claims, 5 Drawing Sheets

U.S. PATENT DOCUMENTS 5,587,705 A 12/1996 Morris
5,589,824 A 12/1996 Lynch
5,592,147 A 1/1997 Wong
5,663,714 A 9/1997 Fray
5,691,703 A 11/1997 Roby et al.
5,694,118 A 12/1997 Park et al.
5,786,768 A 7/1998 Chan et al.
5,973,603 A 10/1999 Judy
6,097,289 A 8/2000 Li et al.
6,144,310 A 11/2000 Morris
6,522,248 B1 * 2/2003 Andres et al. ..... 340/521

* cited by examiner

MULTICONDITION DETECTION APPARATUS AND METHOD PROVIDING INTERLEAVED TONE AND VERBAL WARNINGS

This application is a continuation of application Ser. No. 09/271,574, filed Mar. 18, 1999, now U.S. Pat. No. 6,522, 248, which application(s) are incorporated herein by reference.

FIELD OF THE INVENTION

The instant invention relates to the detection and enunciation of hazardous conditions, and more particularly to the detection and enunciation of smoke, carbon monoxide, and fire in residential and commercial settings.

BACKGROUND OF THE INVENTION

The improvement in reliability, decrease in cost and realization of the lifesaving benefits of commercial and consumer smoke and carbon monoxide detectors have resulted in an increased installation of these devices in homes and businesses. Many homes now include at least one and typically multiple smoke detectors located throughout the residence. Indeed, many state laws require that apartment dwellings include at least one smoke detector within an apartment for single floor plan apartments, and at least one per floor for multi level apartments. Further, many state laws also require that smoke detectors be installed in homes prior to their sale.

Additionally, many homes and apartments are also being equipped with separate carbon monoxide detectors. The increase in installation of these detectors is due in large part to the improved reliability of these detectors which have, for the most part, overcome the false triggering of early devices. This increased use is also due in part to the recognition of people in colder climates that central heating systems, wood burning stoves, and fireplaces are all potential sources of deadly carbon monoxide which, without a carbon monoxide sensor, would go undetected until it was too late. A majority of these carbon monoxide detectors are being installed in dwellings which also include a separate smoke detector.

In recognition of the fact that many residences install both carbon monoxide and smoke detectors within the dwelling, Underwriters Laboratory (UL) has issued an industry standard to distinguish these two alarms. This UL standard requires that a fire/smoke alarm shall sound three (3) beeps at a rate of 0.5 second on, 0.5 second off with a gap between these three beep patterns of 1.5 seconds. The UL standard for CO alarms is similar, to wit four beeps at a rate of 0.1 second on, 0.1 second off with a gap between these four beep patterns of five (5) seconds. Since UL has issued these patterns as an industry standard, detector manufacturers must utilize them for each type of detector they make in order to gain UL approval.

The importance of being able to distinguish these two alarm patterns becomes apparent when the preferred actions for each alarm are compared. Specifically, a resident whose smoke detector has triggered is encouraged to close doors and windows, call the fire department to indicate that a fire has been detected, and immediately leave the dwelling. However, a resident whose carbon monoxide detector has triggered is encouraged to open doors and windows to allow fresh air to enter the dwelling to displace the carbon monoxide gas, and leave the dwelling for a period of time to allow the carbon monoxide gas to escape the dwelling. Some carbon monoxide detector manufacturers also recommend contacting a heating and cooling expert to check and clean the furnace, or alternatively their local fire department to indicate that high levels of carbon monoxide have been detected within their dwelling. Clearly, the preferred actions to be taken upon the detection of these two conditions vastly differ, and may result in a life threatening condition should one be mistaken for the other.

While the benefits of having both smoke detectors and carbon monoxide detectors installed within a dwelling far outweigh any problems associated therewith, problems which may become significant do exist. In addition to the above-described problem associated with the different courses of action to be pursued upon the detection of one of the two conditions, a similar situation may occur if both detectors trigger simultaneously. This situation may very well occur during an actual fire situation where the levels of smoke and carbon monoxide are typically high. In this situation, the sounding of both the carbon monoxide and the smoke detector alarms at the same time are most likely to cause confusion in the resident as to the cause and criticality of the situation. Precious seconds and minutes may be lost while the resident attempts to determine first what this new sound (the combination of the smoke and carbon monoxide detector alarms ringing simultaneously) is, and second, what action to take in response thereto. Therefore, this lack of coordination between the two alarm systems within the residence may lead to unnecessary confusion during a time of critical importance to the safety of the residents within the dwelling.

SUMMARY OF THE INVENTION

In view of the above-described problems existing within the art, and others not specifically elaborated herein, it is a primary object of the instant invention to overcome these problems. Specifically, it is an object of the instant invention to provide a coordinated alarm system which will allow the detection of potentially threatening conditions. It is a further object of the instant invention to provide a detection and alarm system which does not require that the user be able to distinguish separate alarm patterns in order to be informed as to the cause of the alarm. It is further an object of the instant invention to provide a detection and alarm system which will properly signal a resident in a straightforward manner to allow proper action to be taken to avoid injury from the type of situation detected. It is a further object of the instant invention to provide the detection and enunciation of multiple conditions which may occur individually or in combination without the associated problem of having multiple alarms being triggered simultaneously.

In view of these objects, it is a feature of the instant invention that both carbon monoxide and smoke may be detected individually or in combination. It is a further feature of the instant invention that the alarms generated by the detection of these conditions be audibly distinguishable one from another. It is a further feature of the instant invention that, in association with the distinctive alarm patterns, a synthesized human voice will provide warning and/or direction information for the residents of the dwelling. It is an additional feature of the instant invention that the distinctive alarm patterns and synthesized human voice will be interleaved in a fashion to alleviate confusion and foster proper response. It is a further feature of the instant invention that detection of both carbon monoxide and smoke will generate only a single alarm which is interleaved with a synthesized voice message providing an explanation of the probable cause of the alarm and/or direction as to the proper action to be taken.

In view of the above objects and features, it is an aspect of the instant invention that the carbon monoxide and smoke detectors, the multi-tone or multi-pattern alarm, and the voice synthesizer be housed in a compact integrated unit for installation in the home or business. It is a further aspect of the instant invention that the integrated unit include control processing technology which allows for a coordination of the sensing, detection, alarm sounding, voice message generation, and interleaving thereof. It is a further aspect of the instant invention to allow for the voice synthesized message to be generated in multiple languages selectable by the user to further enhance its effectiveness.

A preferred embodiment of the apparatus for the detection and enunciation of hazardous conditions within an environment of the instant invention comprises at least a first and a second detection circuits positioned to sense ambient conditions within the environment. An alarm circuit is responsive to both of the detection circuits, and generates at least a first alarm pattern, and preferably a distinct alarm pattern for each detected condition. The apparatus also comprises a voice synthesizer circuit which generates at least a first voice message, and preferably a distinct alarm pattern for each detected condition. An interleaving control circuit is preferably coupled to the alarm circuit and to the voice synthesizer circuit, and causes an enunciation circuit to selectively broadcast at least the first alarm pattern and the first voice message.

In a preferred embodiment, the apparatus includes both smoke and carbon monoxide detectors, each triggering a distinct alarm pattern and warning voice message. Preferably, the alarm circuit also generates a third alarm pattern which is characteristic of the presence of both smoke and carbon monoxide. A preferred embodiment of the voice synthesizer circuit generates voice messages in multiple selectable languages.

A preferred method of the instant invention for the detection and enunciation of multiple hazardous condition within an environment is also presented, and comprises the steps of: (a) sensing ambient conditions within the environment to detect at least two hazardous condition; (b) generating an alarm pattern and a voice message in response to sensing the hazardous conditions; (c) interleaving the alarm pattern and the voice message; and (e) enunciating these interleaved alarm patterns and voice. The interleaving of the alarm pattern and voice messages is preferably performed by the steps of: (f) enabling enunciation of the alarm pattern for a first period of time; (g) disabling enunciation of the alarm pattern at the expiration of the first period of time; (h) enabling enunciation of the voice message at the expiration of the first period of time for a second period of time; and (i) disabling enunciation of the voice message at the expiration of the second period of time. These steps are repeated until a reset is received.

These and other aims, objectives, and features of the invention will become more apparent from the following detailed description when taken in conjunction with the accompanying drawings.

Figure 1:
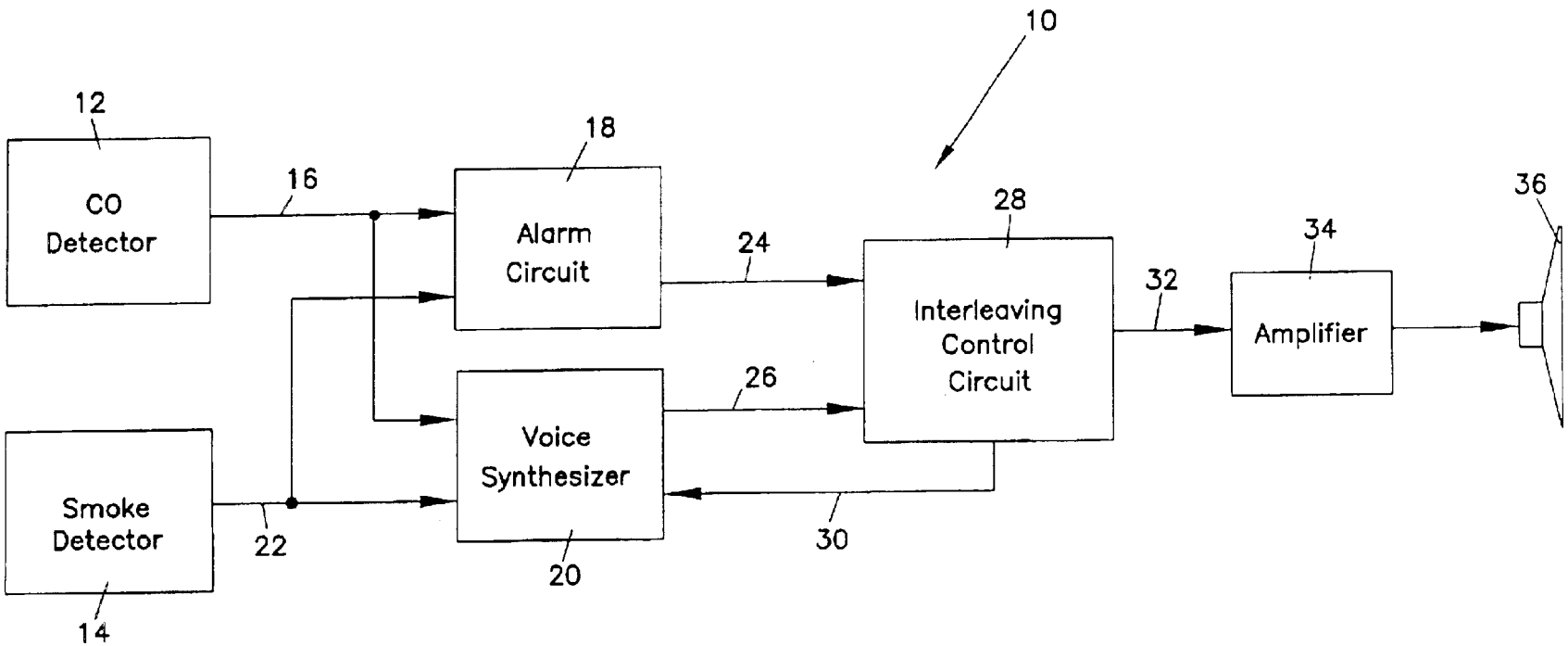
FIG. 1 is a simplified block diagrammatic illustration of an embodiment of the instant invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

A preferred embodiment of the instant invention is illustrated in block diagrammatic form in FIG. 1. As may be seen from an examination of this figure, a detector of the instant invention 10 comprises both a carbon monoxide detector 12 and a smoke detector 14. As will become apparent to those skilled in the art from the following description, other detectors may be integrated in the detector of the instant invention 10 without departing from the spirit and scope of the invention as will be defined by the claims appended hereto. These detectors 12, 14 may be of conventional design utilizing various topologies known in the art.

In a preferred embodiment of the instant invention, the output 16 from the carbon monoxide detector 12 is coupled to both an alarm circuit 18 and a voice synthesizer 20. Likewise, the output 22 from the smoke detector 14 is also coupled to both the alarm circuit 18 and the voice synthesizer 20. The output 24, 26 from each of these circuits 18, 20 are coupled to an interleaving control circuit 28. In a preferred embodiment, this interleaving control circuit 28 also includes a synthesizer enable output 30 which is coupled back to the voice synthesizer 20. The output 32 of the interleaving control circuit 28 is coupled through an amplifier 34 to at least one device speaker 36.

The operation of the embodiment of the instant invention illustrated in FIG. 1 will now be described under three separate conditions. First, assuming high levels of carbon monoxide in the environment within which the detector 10 is located, the carbon monoxide detector 12 will generate an output signal on line 16 to both the alarm circuit 18 and the voice synthesizer 20. The receipt of the carbon monoxide detector input 16 by the alarm circuit 18 will result in a generation of an alarm pattern on line 24. Additionally, the voice synthesizer circuit 20 will select the carbon monoxide appropriate message to pass to the interleaving control circuit 28 via line 26. The interleaving control circuit 28 is responsible for interleaving the voice synthesized message with the alarm patterns in an appropriate manner. Preferably, the interleaving control circuit includes timing elements which first pass the alarm patterns on line 24 to the output 32 for a given period of time. After the expiration of the given period of time, the interleaving control circuit then preferably enables the voice synthesizer 20 via an enable signal on line 30 to allow the voice synthesizer to generate the voice synthesized appropriate message for the carbon monoxide detection condition. Through the use of the enable signal 30 the interleaving control circuit 28 may ensure that the signal passed from line 26 to output 32 always begins at the start of the message generated by the voice synthesizer 20. After the voice synthesized message 26 has been played at least one time, the interleaving control circuit 28 then reverts back to the alarm patterns generated by the alarm circuit for a given period of time. The interleaving control circuit 28 continues to operate in similar fashion, alternatively passing the alarm patterns and voice synthesized message to amplifier 34 for broadcast by the speaker 36.

While the above description includes an enable signal on line 30 to enable the voice synthesizer to begin transmitting its voice synthesized message on line 26, one skilled in the art will recognize that the interleaving control circuit 28 may accomplish its function without the use of a voice synthesizer enable command through appropriate timing control. Without the use of an enable signal 30, both the alarm circuit 18 and the voice synthesizer 20 would begin transmitting on outputs 24, 26, and would continuously transfer their generated message or alarm pattern to the interleaving control circuit 28. It would then be the responsibility of the interleaving control circuit 28 to interleave these two signals 24, 26 so that the output 32 to amplifier 34 would allow for proper broadcasting by speaker 36. By proper broadcasting it is meant that the detector 10 broadcasts an audible alarm pattern which is interleaved at given intervals with a voice synthesized message providing indication of the alarm condition, and may include directions for the dwelling occupants. The interleaving would be preferably controlled such that the voice synthesized message is broadcasted from its beginning until its completion before interleaved again with the alarm patterns. In this way, confusion is minimized by the interleaved coordination of the alarm pattern and voice synthesized signal.

Further, the level of CO detected may be used to select different appropriate voice synthesized messages. UL publishes various levels of CO and their associated exposure time hazard. For example, a low level of detected CO becomes hazardous as the length of exposure is increased, while high levels of CO can be lethal for very short duration exposure. Recognizing this fact, an embodiment of the detector of the instant invention may incorporate different messages based on the detected level of CO. A low level of detected CO may result in a cautionary warning while a high level of detected CO may result in an emergency evacuation warning. The overall pattern of the warnings may be different or the same. If different, the low level cautionary warning may be enunciated at a much slower rate, i.e. more time passing between repetition of the pattern of voice and alarm tones, than that required for a high level. A similar level detection may be included for the smoke detection if desired.

Operation during a smoke condition is similar to that described above, with the exception that the initial detector signal is generated by the smoke detector 14 on line 22. Once the signal 22 is generated and passed to the alarm circuit 18 and the voice synthesizer circuit 20 the appropriate outputs are generated on lines 24 and 26. The appropriate output from the alarm circuit 18 on line 24 may be the same alarm pattern signal as was generated in response to the receipt of input 16, or, more preferably, is a separate distinct alarm pattern which allows differentiation between the detected conditions. Likewise, the voice synthesizer 20 may generate a generic occupant warning message on line 26 regardless of the receipt of the signal on line 16 or the signal on line 22, or may, more preferably, generate a separate distinct voice synthesized message characteristic of the type of input received. In a preferred embodiment of the instant invention, therefore, the signal 24 generated by alarm circuit 18 in response to a signal on line 22 representative of a detected smoke condition is a distinct alarm pattern signal from that generated upon receipt of signal 16 representative of a carbon monoxide condition. Likewise, the output from voice synthesizer 20 provides a smoke appropriate message on line 26 in response to the receipt of the signal on line 22. As described above, this voice synthesized message may provide the occupant with an indication of the sensed condition as well as instructions as may be appropriate. The interleaving control circuit 28 operates in similar fashion as that described above, and for the sake of brevity, will not be described again.

A third situation is possible, particularly during a fire situation within the dwelling. This condition results in both the generation of smoke which will be detected by smoke detector 14 as well as the generation of carbon monoxide which will be detected by a carbon monoxide detector 12. As a result of the dual generation of both carbon monoxide and smoke, the outputs on lines 16 and 22 will both be present at the alarm circuit 18 and the voice synthesizer circuit 20. During this condition, the alarm circuit 18 may generate the same alarm pattern generated above on line 24, or more preferably a third distinct alarm pattern indicative of the fire condition. Likewise, the voice synthesizer 20 may also generate the generic message on line 26 indicating a dangerous condition within the dwelling, or may, more preferably, generate a unique message which is appropriate to the sensed condition. As described above, the interleaving control circuit 28 operates to interleave these alarm patterns 24, and voice synthesized message 26 in the manner described above.

Figure 2:
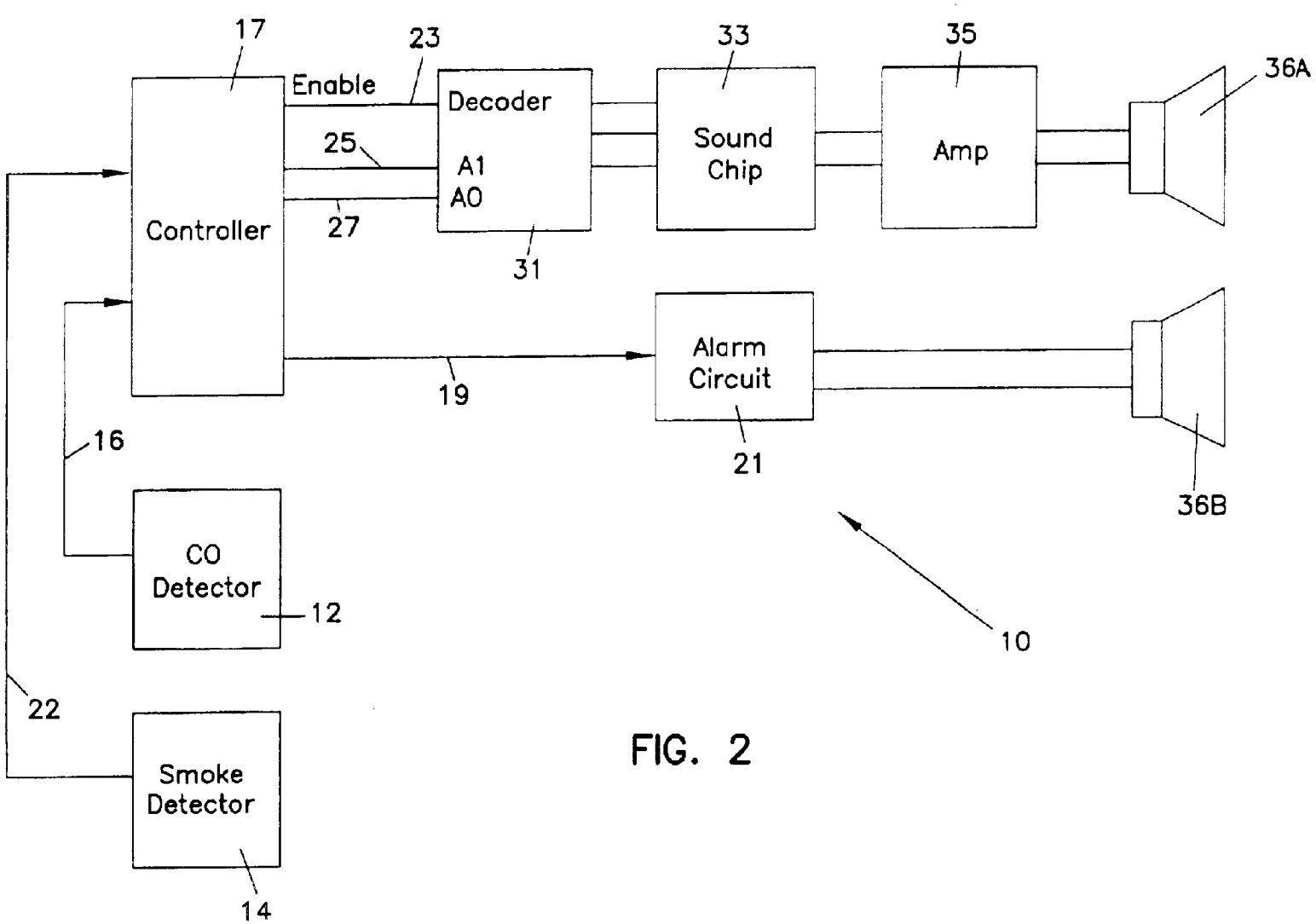
FIG. 2 is a simplified block diagrammatic illustration of an alternate embodiment of the instant invention.

In an alternate embodiment of the instant invention, as illustrated in simplified block diagrammatic form in FIG. 2, the output 16 from the carbon monoxide detector 12 and the output 22 from smoke detector 14 are both coupled to controller 17. The controller 17 analyzes the inputs 16, 22 and generates an appropriate alarm signal 19 to alarm circuit 21 which, in response, drives speaker 36B. In this embodiment of the instant invention the controller 17 analyzes the inputs 16, 22 to determine the appropriate signal to generate on line 19 to drive alarm circuit 21 in the appropriate manner in accordance with the UL specification as described above. In addition to the appropriate alarm signal generated by controller 17 on line 19, this controller 17 also generates an output voice enable signal 23 to enable the generation of the voice synthesized message. In this embodiment, the controller 17 also transmits via address lines 25, 27 a coded signal to decoder 31 to select the appropriate message based on the sensed conditions from inputs 16, 22. The decoded signals are transmitted to the voice synthesizer sound chip 33 which then transmits the appropriate voice synthesized message to amplifier circuit 35 to drive output speaker 36A. As illustrated in this embodiment, two separate speakers 36A, 36B are utilized to provide maximum effectiveness and pattern quality for the two types of signals generated by the detector of the instant invention 10. However, one skilled in the art will recognize that appropriate selection of the proper speaker may allow for the use of a single output speaker 36 illustrated above in FIG. 1.

Figure 3:
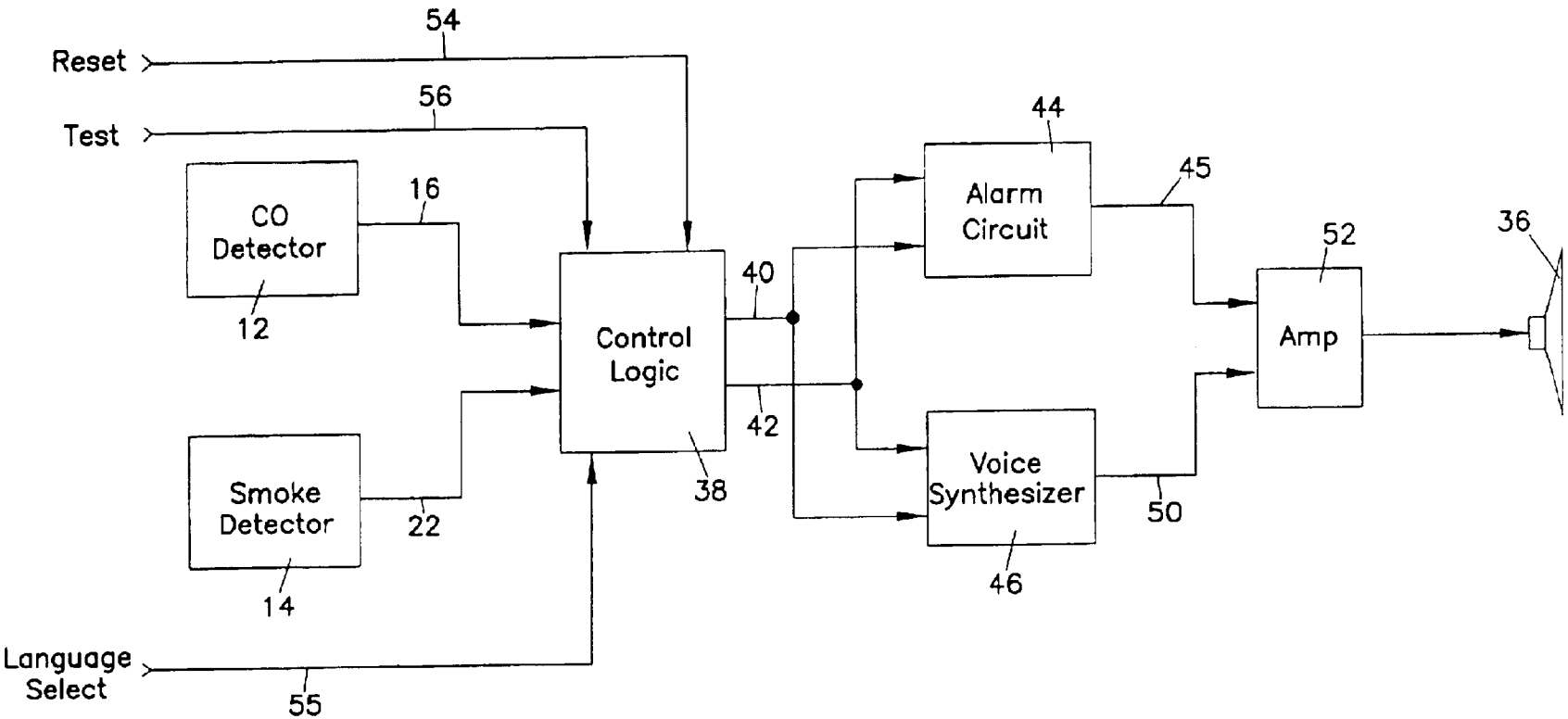
FIG. 3 is a simplified block diagrammatic illustration of a further alternate embodiment of the instant invention.

Yet another alternate preferred embodiment of the instant invention is illustrated in simplified block diagrammatic form in FIG. 3, to which specific reference is now made. As may be seen from this FIG. 3, the output 16, 22 from the carbon monoxide detector 12 and smoke detector 14 respectively are coupled to control logic circuitry 38. The control logic 38 analyzes the inputs 16, 22 and generates an output select signal 40 and an output enable signal 42. Each of these signals 40, 42 are received by an alarm circuit 44 and a voice synthesizer circuit 46. The output on line 48 from the alarm circuit 44 is coupled to amplifier 52, as is the output 50 from voice synthesizer 46. The amplifier 52 drives an output speaker 36 in a conventional manner. Preferably, both an alarm reset signal 54 and an alarm test signal 56 are coupled to the control logic 38 to allow resetting, and testing of the appropriate circuits to ensure proper operation during the installed life of the device 10. Additionally, a language select signal 55 may also be provided as an input to logic 38 (or alternatively to voice synthesizer 46 directly).

The operation of this embodiment of the instant invention will also be described in relation to three separate operating conditions: carbon monoxide only; smoke only; and both carbon monoxide and smoke in combination. First, during the presence of high levels of carbon monoxide, detector 12 generates a signal on line 16 which is transmitted to the control logic 38. The control logic 38 processes the input 16 and generates an output select signal on line 40 indicative of a detected carbon monoxide gas condition. Both the alarm circuit 44 and the voice synthesizer circuit 46 then select the appropriate pattern and message respectively for eventual transmittal via lines 48 and 50 to an amplifier 52. The control logic 38 alternately enables the alarm circuit 44 and the voice synthesizer 46 via line 42 to allow each circuit in turn to generate its output to amplifier 52. Specifically, the control circuit 38 first enables one of the circuits, e.g. alarm circuit 44, for a predetermined period of time, followed by the enabling of the other circuit, e.g., voice synthesizer 46. Preferably, only one of the circuits 44, 46 are enabled at any one time to allow for clear broadcasting of either the alarm pattern or the appropriate voice synthesized message. As described above, and as will be recognized by one skilled in the art, both the alarm circuit and the voice synthesizer circuit may generate single or multiple patterns and messages as desired. Preferably, both the alarm circuit 44 and the voice synthesizer circuit 46 will generate unique patterns and messages indicative of the sensed condition by detectors 12 and 14.

Once the control logic has begun to trigger the alarm circuit 44 and the voice synthesizer circuit 46, it will preferably continue to do so until reset manually by a user on line 54. This reset input 54 may be via a push button switch or other appropriate circuitry as appropriate and desired. In addition to the reset line 54, provision is also made to allow a user to test the alarm functionality of the unit 10 via a test input 56. As with the reset, this test signal 56 may be generated by a push button switch or other appropriate circuitry as desired. Additionally, one skilled in the art will recognize that the function provided by inputs 54, 56 may be accomplished through a single input. In this way, if the control logic is generating the select and enable signals 40, 42, the receipt of the single combined input will be processed as a reset signal, whereas if the control logic 38 is not generating the select and enable signals 40, 42, the receipt of the combined input will be processed as a test signal.

The use of control logic 38 also allows the unit 10 to detect and enunciate varying levels of the detected conditions. In this way, the unit 10 may alert occupants to the formation of a potentially dangerous situation at earlier, lower detection levels. The control logic 38 may also store historical information of detected conditions and levels, and utilize this information to enunciate the existence of a persistent low level problem. For example, a furnace which is beginning to burn inefficiently or require cleaning may generate low levels of carbon monoxide each time the furnace operates. While these low levels of carbon monoxide generation may be too low to warrant a warning of dangerous levels of carbon monoxide, an analysis of the historical detection of these low levels of carbon monoxide will allow the control logic 38 to inform the occupant of the possible beginnings of a problem. In this way, a potential problem may be detected and corrected much earlier, before the situation becomes critical. The control logic 38 may also use other combinational logic to control the output alarm pattern and synthesized message generation. For example, during the detection of a smoke condition, if the reset input 54 is also triggered while the existence of smoke is still being detected by detector 14, the control logic 38 could disable the alarm and synthesized message generation until the presence of smoke has been eliminated and returns. Such a feature may be advantageous if the cause of the smoke is from cooking or other controlled situations where the occupant is aware of the problem but does not wish to be continuously alerted to the situation by the unit 10.

The second condition of operation of the unit 10, as has been briefly discussed above, is the detection of smoke by detector 14. The smoke detector 14 transmits its output on line 22 to control logic 38 which then, in similar fashion to the above-described situation, transmits an output select signal to alarm circuit 44 and voice synthesizer circuit 46 to allow each of the circuits to select the proper pattern and voice synthesized message. The control logic 38 then alternatively enables the alarm circuit 44 and the voice synthesizer circuit 46 via output enable signal 42. As described above, alarm circuit 44 may generate a unique pattern for the smoke condition, or may utilize a generic pattern warning of a dangerous condition. Likewise, voice synthesizer 46 may also generate a generic warning message to the occupants of a dangerous condition, or may generate a specific message directed to the sensed condition.

The voice synthesized message may be generated in a single language, in multiple languages, or in a language which is user selectable upon initial installation via line 55. The selection of the appropriate language or language combination may be accomplished directly within the voice synthesizer 46, or may preferably be accomplished within the control logic 38 and transmitted to the voice synthesizer 46 via the condition select lines 40. This selection may be accomplished via a simple selector switch, a push button switch which allows cycling through the available languages, or other appropriate user interface.

The third sensed condition is that of both high levels of carbon monoxide and smoke which occur during many actual fire situations. During this condition, the control logic 38 receives input signals on both lines 16 and 22. The control logic recognizes this condition and selects the appropriate alarm pattern and voice synthesized message via the output selector signal 40. As described above, both the alarm circuit 44 and the voice synthesizer circuit 46 may generate a generic warning, or more preferably a distinctive alarm pattern and appropriate warning message for this particular sensed condition. Also, as described above, the control logic then interleaves the operation of the alarm circuit 44 and the voice synthesizer 46 via the enable line 42.

Figure 4:
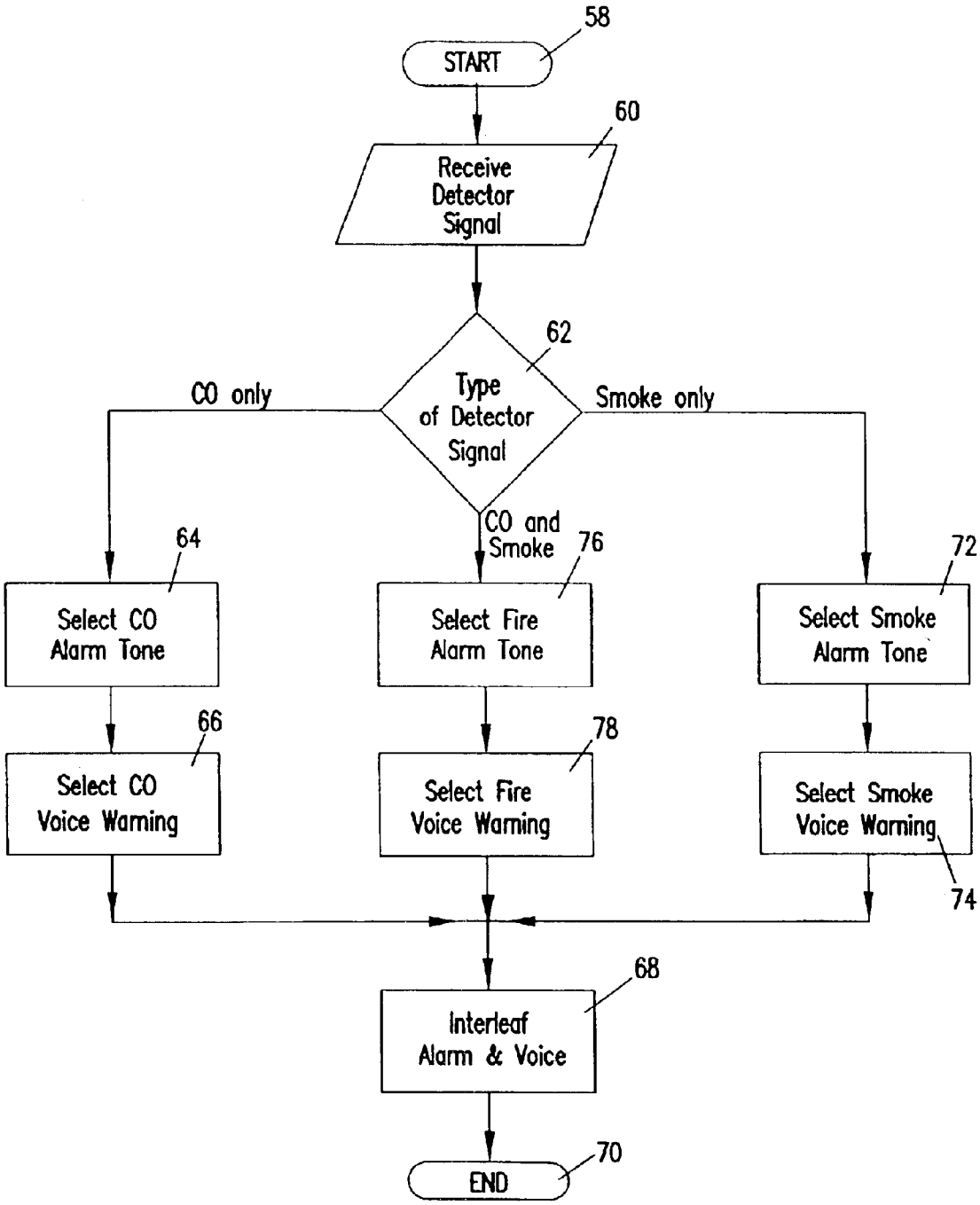
FIG. 4 is a functional flow diagram illustrating operational aspects of the instant invention.

The above-described operation is illustrated in flow diagrammatic form in FIG. 4, to which specific reference is now made. As may be seen from this figure, upon initiation 58 the control logic 38 (see FIG. 3) receives 60 the detector signal from the associated detector circuits. The control logic 38 determines the type of detector signal received at decision block 62. If the carbon monoxide signal is the only signal received by the control logic 38, the carbon monoxide alarm pattern is selected 64, as is the carbon monoxide voice warning 66. The control logic interleaves the alarm and voice warnings 68 until the process is terminated 70. If, however, decision block 62 determines that the smoke detector signal is the only signal received, the smoke alarm pattern is selected 72 as is the smoke voice warning message. As with the previous condition, the control logic interleaves the alarm and voice messages 68 until the process is terminated 70. If both the smoke and carbon monoxide detector outputs are received 60 as determined by the decision block 62, the fire alarm pattern is selected 76 as is the fire voice warning 78. These signals are also interleaved 68 as described above until the process is terminated 70.

Figure 5:
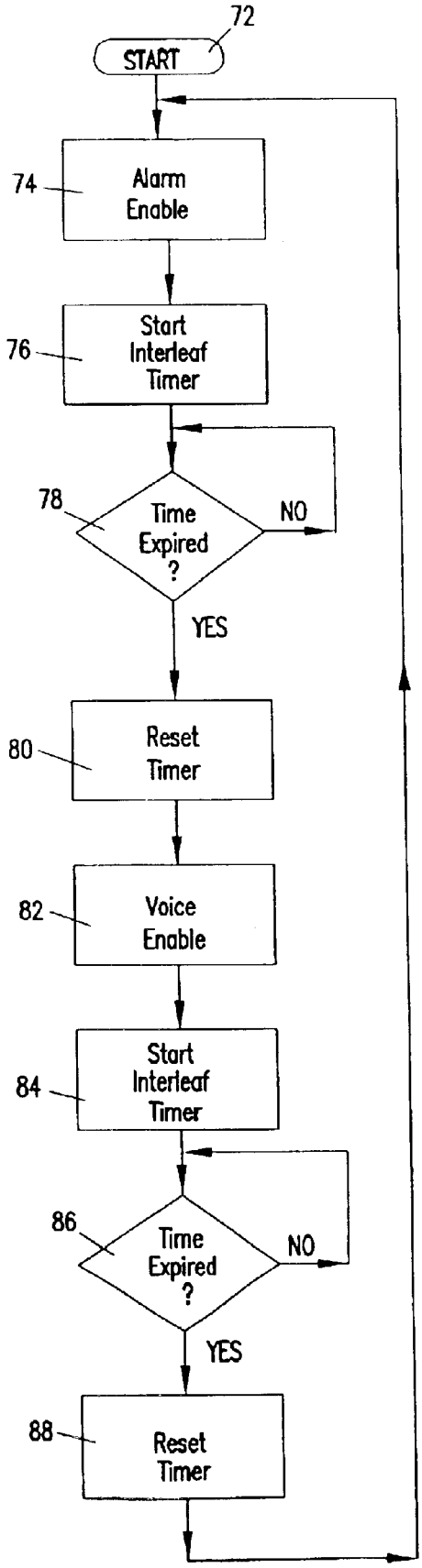
FIG. 5 is a functional flow diagram illustrating in greater detail a particular operated aspect of an embodiment of the instant invention.

While the interleaving of the alarm pattern and voice message may be accomplished in various manners, a preferred method of interleaving is illustrated in FIG. 5. Once the interleaving process begins 72 the alarm circuitry is enabled 74. An interleaving timer is started 76 once the alarm has been enabled 74 to allow the alarm to sound for a predetermined period of time. Once it has been determined that the time has expired 78 the timer is reset 80 and the voice synthesizer circuitry is enabled 82. Once enabled, the interleaving timer is started 84 and allows the generation of the voice synthesized signal for a predetermined period of time. Once this time has expired 86, the timer is reset 88 and the process is continued. While the flow diagram of FIG. 5 illustrates that the alarm circuit is enabled first, one skilled in the art will recognize that either the alarm of the voice message may be enabled initially upon detection of the condition. The interleaving timer for the pattern and voice message may be the same, or may be different, but preferably allow the voice message to begin and run to its completion at least one time before re-enabling the alarm circuit for pattern generation and broadcast.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. The details of the structure and architecture may be varied substantially without departing from the spirit of the invention, and the exclusive use of all modifications which come within the scope of the appended claims is reserved.

What is claimed is:

1. An apparatus for the detection and enunciation of hazardous conditions within an environment, comprising:

at least a first and a second detection circuits to sense ambient conditions within the environment, said first detection circuit configured to sense a first hazardous condition, said first detection circuit producing a first condition output signal in response thereto, and said second detection circuit configured to sense a second hazardous condition, said second detection circuit producing a second condition output signal in response thereto;

an alarm circuit responsive to said first and to said second output signals for generating at least a first alarm pattern;

a voice circuit responsive to said first and to said second output signals for generating at least a first voice message;

an enunciation circuit; and an interleaving control circuit coupled to said alarm circuit and to said voice circuit, said interleaving control circuit causing said enunciation circuit to selectively broadcast at least said first alarm pattern and said first voice message.

2. The apparatus of claim 1, wherein said voice message comprises an indication of detected conditions.

3. The apparatus of claim 2, wherein said voice message further comprises directions.

4. The apparatus of claim 1, wherein said interleaving control circuit determines an order and a timing of said first alarm pattern and said first voice message.

5. The apparatus of claim 4, wherein said interleaving control circuit determines an order and a timing of said first alarm pattern and said first voice message using a voice enable command.

6. The apparatus of claim 4, wherein said interleaving control circuit determines an order and a timing of said first alarm pattern and said first voice message using timing control.

7. The apparatus of claim 1, wherein said first voice message is selected from a plurality of voice messages.

8. The apparatus of claim 7, wherein said plurality of voice messages comprises messages indicating levels of detected conditions.

9. The apparatus of claim 8, wherein said plurality of voice messages comprises messages indicating levels of carbon monoxide concentration.

10. The apparatus of claim 8, wherein said plurality of voice messages comprises messages indicating levels of smoke concentration.

11. The apparatus of claim 7, wherein said plurality of voice messages comprises messages indicating exposure time information.

12. The apparatus of claim 7, wherein said interleaving control circuit selectively broadcasts said first alarm pattern and said first voice message at a variable rate.

13. The apparatus of claim 12, wherein said variable rate is determined based on detected conditions.

14. The apparatus of claim 1, further comprising a first speaker for enunciating said first alarm pattern, and a second speaker for enunciating said first voice message.

15. The apparatus of claim 1, further comprising control logic for controlling said apparatus.

16. The apparatus of claim 15, wherein said control logic stores historical information regarding detected conditions.

17. The apparatus of claim 16, wherein said control logic stores historical information regarding levels of detected conditions.

18. The apparatus of claim 15, wherein said control logic identifies sub-alarm level conditions, and controls said enunciation circuit to enunciate said sub-alarm level conditions.

19. The apparatus of claim 15, wherein said control logic is adapted to temporarily disable said alarm circuit.

20. The apparatus of claim 1, wherein the voice circuit comprises voice synthesizer circuitry.

21. A method for the detection and enunciation of hazardous condition within an environment, comprising the steps of:

sensing ambient conditions within the environment to detect at least a first and a second hazardous condition;

generating at least a first alarm pattern and at least a first voice message in response to sensing at least one of the first hazardous condition and the second hazardous condition;

interleaving said first alarm pattern and said first voice message; and enunciating said interleaved first alarm pattern and first voice message in response to sensing at least one of the first hazardous condition and the second hazardous condition;

wherein said first voice message comprises an indication of detected conditions.

22. A method for the detection and enunciation of hazardous condition within an environment, comprising the steps of:

sensing ambient conditions within the environment to detect at least a first and a second hazardous condition;

generating at least a first alarm pattern and at least a first voice message in response to sensing at least one of the first hazardous condition and the second hazardous condition;

interleaving said first alarm pattern and said first voice message;

determining an order and a timing of said first alarm pattern and said first voice message; and enunciating said interleaved first alarm pattern and first voice message in response to sensing at least one of the first hazardous condition and the second hazardous condition.

23. A method for the detection and enunciation of hazardous condition within an environment, comprising the steps of:

sensing ambient conditions within the environment to detect at least a first and a second hazardous condition;

generating at least a first alarm pattern in response to sensing at least one of the first hazardous condition and the second hazardous condition, and selecting at least a first voice message from a plurality of voice messages in response to sensing at least one of the first hazardous condition and the second hazardous condition;

interleaving said first alarm pattern and said first voice message; and enunciating said interleaved first alarm pattern and first voice message in response to sensing at least one of the first hazardous condition and the second hazardous condition.

24. A method for the detecting and enunciation of hazardous condition within an environment, comprising the steps of:

sensing ambient conditions within the environment to detect at least a first and a second hazardous condition;

generating at least a first alarm pattern and at least a first voice message in response to sensing at least one of the first hazardous condition and the second hazardous condition;

interleaving said first alarm pattern and said first voice message; and enunciating said first alarm pattern with a first speaker and enunciating said first voice message with a second speaker in response to sensing at least one of the first hazardous condition and the second hazardous condition.

25. A method for the detection and enunciation of hazardous condition within an environment, comprising the steps of:

sensing ambient conditions within the environment to detect at least a first and a second hazardous condition;

generating at least a first alarm pattern and at least a first voice message in response to sensing at least one of the first hazardous condition and the second hazardous condition;

interleaving said first alarm pattern and said first voice message; and enunciating said interleaved first alarm pattern and first voice message in response to sensing at least one of the first hazardous condition and the second hazardous condition;

controlling said method using control logic.

26. An apparatus for the detection and enunciation of a hazardous condition within an environment, comprising:

at least a first detection circuit and a second detection circuit to sense ambient conditions within the environment, said first detection circuit configured to sense a first hazardous condition and produce a first condition output signal in response thereto, and said second detection circuit configured to sense a second hazardous condition and produce a second condition output signal in response thereto;

alarm circuitry responsive to said first and to said second output signals for generating at least a first alarm pattern signal;

voice message circuitry responsive to said first and to said second output signals for generating at least a first voice message signal;

enunciation circuitry; and interleaving control circuitry coupled to said alarm circuitry and to said voice message circuitry, said interleaving control circuitry causing said enunciation circuitry to selectively broadcast at least an alarm pattern based on said first alarm pattern signal and a voice message based on said first voice message signal.

27. The apparatus of claim 26, wherein the voice message circuitry comprises voice synthesizer circuitry.

28. An apparatus for the detection and enunciation of a hazardous condition within an environment, comprising:

at least one detection circuit to sense ambient conditions within the environment, said detection circuit configured to sense a hazardous condition and produce a hazardous condition output signal in response thereto;

logic circuitry configured to enable the apparatus to store historical information of a detected hazardous condition and generate a reporting signal;

alarm circuitry responsive to said output signal for generating an alarm pattern signal;

voice message circuitry responsive to said output signal for generating a voice message signal;

enunciation circuitry for enunciating a report based on said reporting signal, an alarm pattern based on said alarm pattern signal, and a voice message based on said voice message signal; and interleaving control circuitry coupled to said alarm circuitry and to said voice message circuitry, said interleaving control circuitry causing said enunciation circuitry to selectively broadcast in an interleaved manner the alarm pattern based on said alarm pattern signal and the voice message based on said voice message signal.

29. The apparatus of claim 28, wherein the detection circuit is configured to sense one of smoke or carbon monoxide.

30. The apparatus of claim 28, further comprising an additional detection circuit configured to sense a second hazardous condition and produce a second hazardous condition output signal in response thereto.

31. The apparatus of claim 30, wherein the hazardous condition output signals vary based on the sensed levels of the hazardous conditions.

32. The apparatus of claim 31, wherein said voice message circuitry includes a plurality of voice messages corresponding to varying levels of the sensed hazardous conditions, and said voice message circuitry is responsive to said output signals for generating voice message signals corresponding to one of the voice messages.

33. The apparatus of claim 28, wherein the voice message circuitry comprises voice synthesizer circuitry.

34. The apparatus of claim 33, further comprising reset circuitry actuatable by a user to reset the apparatus.

35. The apparatus of claim 28, further comprising test circuitry actuatable by a user to test functionality of the apparatus.

* * * * *